United States Patent [19]

Ostrem et al.

[11] 4,003,496

[45] Jan. 18, 1977

[54] END CLOSURE FOR CONTAINER

[75] Inventors: Obert M. Ostrem, Westmont; Donald F. Kulikowski, Oak Forest; Sam C. Pulciani, Norridge, all of Ill.

[73] Assignee: The Continental Group, Inc., New York, N.Y.

[22] Filed: Feb. 17, 1976

[21] Appl. No.: 658,446

[52] U.S. Cl. ..... 220/270; 113/121 C

[51] Int. Cl.[2] ..... B65D 41/32

[58] Field of Search ..... 220/270–273; 113/121 C, 90.6

[56] References Cited

UNITED STATES PATENTS

| | | | |
|---|---|---|---|
| 3,335,899 | 8/1967 | Dunn | 220/270 |
| 3,543,961 | 12/1970 | Kennedy | 220/273 |
| 3,865,268 | 2/1975 | Coop | 215/256 X |

*Primary Examiner*—George T. Hall
*Attorney, Agent, or Firm*—Paul J. Lerner; Joseph E. Kerwin; John J. Kowalik

[57] ABSTRACT

An easy-opening end closure of the full opening type is formed with the flap-defining score-line located in the vertical chuck wall whereat the cutedge, of that portion of the closure remaining attached to the container after opening, is shielded by the container sidewall.

The disclosure also relates to a method for forming the above described easy-opening end closure wherein the scoreline is formed in a horizontal portion of the end panel, said portion thereafter being upset to a substantially vertical position whereat it comprises a part of the chuck wall.

1 Claim, 4 Drawing Figures

END CLOSURE FOR CONTAINER

BACKGROUND OF THE INVENTION

The present invention relates to a new and improved easy-opening end closure of the full opening type and, more particularly, to a method for forming the same.

Full opening end closures generally include an end panel formed with an annular scoreline located closely adjacent to the chuck wall. This scoreline defines a removable flap to which there is attached a tab member. A second or opening scoreline, also formed in the end panel, operatively connects the tab with the flap-defining annular scoreline. The tab is mounted such that lifting thereof causes a fracture of the opening scoreline. Thereafter, the tab is pulled upwardly to separate the flap from the remainder of the end panel.

The opening thus formed in the end closure is bounded by a horizontal ledge which terminates in a sharp raw edge produced by the severance of the removable panel portion therefrom. This sharp edge may present a hazard to the user.

SUMMARY OF THE INVENTION

By the present invention, it is proposed to provide a full opening easy-open end closure constructed and arranged so as to provide a shield for the raw edge of the end panel portion remaining on the container after opening.

This is accomplished generally by an end closure wherein the annular scoreline is located in the axial chuck wall whereat the cutedge is shielded by the container sidewall subsequent to opening.

It is another object to provide a new and novel method for forming a full opening easy-open end closure constructed in the manner specified in the foregoing object.

This is accomplished by forming the annular scoreline in a horizontal portion of the end panel and thereafter upsetting said portion to a substantially axial position whereat it comprises a part of the chuck wall.

With the above and other objects in view that will hereinafter appear, the nature of the invention will be more readily understood by reference to the following description, the appended claims and the several views illustrated in the accompanying drawings.

DESCRIPTION OF THE PREFERRED EMBODIMENT

Figure 1:
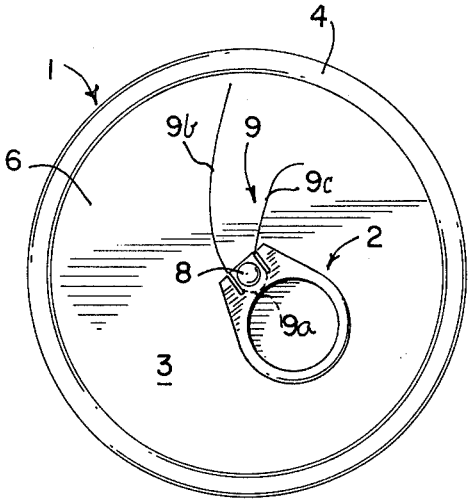
FIG. 1 is a top plan view of the end closure of the present invention.
Figure 2:
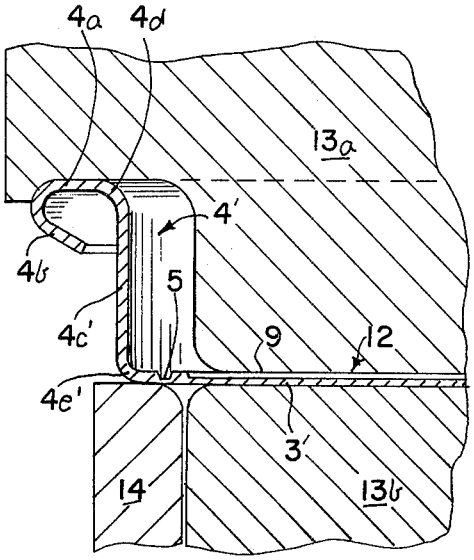
FIG. 2 is a fragmentary cross-sectional view taken of FIG. 1, illustrating one stage in the formation of the end closure of FIG. 1.

In accordance with the present invention, there is provided an easy-open end closure having an end panel 1 and a tab member 2.

The end panel 1 includes a substantially flat, horizontal central web 3 and a peripheral portion 4. The peripheral portion 4 comprises a seaming panel **4*a*, a curl 4*b*** integral with the outer edge of said seaming panel

**4*a*, a substantially axial chuck wall 4*c* at the inner edge of said seaming panel 4*a*, a seaming panel radius 4*d* integrally connecting the upper end of said chuck wall 4*c* with said seaming panel 4*a*, and a chuck wall radius 4*e* integrally joining the lower end of said chuck wall 4*c* with the central web 3**.

An annular scoreline 5 is formed in the inner surface of the chuck wall **4*c*, proximate the lower end thereof, and defines a removable flap 6**.

The tab member 2, of a type well known in the art, is attached to the central web 3 by a rivet 8.

A generally U-shaped opening scoreline 9 is formed in the end panel 1 proximate the center thereof, with the bight portion **9*a* embracing the rivet 8, the legs 9*b* and 9*c* of the U being curved and diverging toward the annular scoreline 5. The leg 9*b* is longer than leg 9*c* and approaches, but does not touch, the annular scoreline 5 (experience indicates that joining of the two scorelines 5 and 9 results in cracking of the end panel 1** in the area of the juncture).

Opening of the closure is effected in the conventional manner by lifting and pulling the tab member 2.

Figure 4:
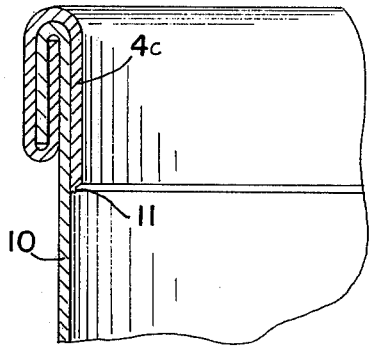
FIG. 4 is a fragmentary cross-sectional view of the end closure of the present invention, double seamed to a container sidewall, with the flap removed.

As best illustrated in FIG. 4, when the end closure is attached to a container, the chuck wall **4*c* abuts the container sidewall 10. After the flap 6 is removed, the cutedge 11 on the chuck wall 4*c* is shielded by the sidewall 10**, so as to protect the user from possible injury.

In fabricating the above-described end closure, there is first provided a metal blank 12 having a substantially flat central web 3' and a generally upstanding peripheral portion 4' substantially as previously described. The annular and opening scorelines 5 and 9 have been formed in the blank 12, the annular scoreline 5, at this point, being located in the central web 3' adjacent the peripheral portion 4'.

The blank 12 is clampingly held between upper and lower dies **13*a* and 13*b* respectively, the dies engaging a portion only of the central web 3'. The upper die 13*a* is configured to conform to the desired final cross-section of the closure. An annular punch 14 encircles the lower die 13*b***.

Figure 3:
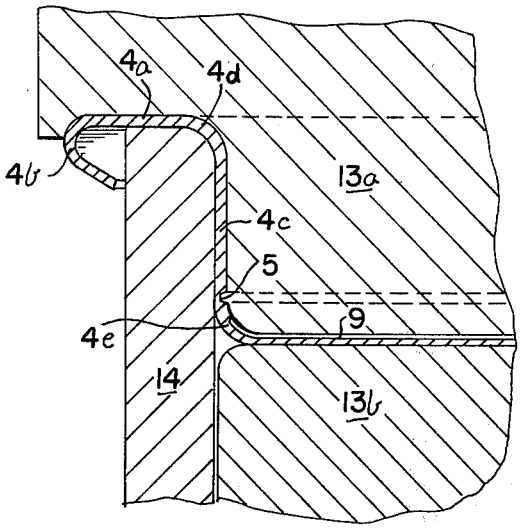
FIG. 3 is a fragmentary cross-sectional view similar to FIG. 2, illustrating a second stage in the formation process.

As best shown in FIG. 3, the punch 14 is advanced toward the upper die **13*a*, thereby upsetting the portion of the central web 3' adjacent the annular scoreline 5, such that the upset portion of the web 3' merges into substantially coplanar relation with the chuck wall 4*c'* being displaced radially inwardly and becomes an extension thereof. This reduction in the length of the annular scoreline 5** results in the forces impressed thereon during the reformation being primarily compressive rather than tensile. This avoidance of tensile loading prevents score fracture during the forming process.

The tab member 2 is attached to the end panel 1 by means well known in the art to complete the closure.

We claim:

1. An improved end panel for an easy-opening end closure of the full opening type comprising a central web, and a peripheral portion, said peripheral portion including a substantially axial chuckwall for placement in close association with the sidewall of a can or similar container, the improvement comprising a scoreline disposed in the outer surface of said chuckwall and formed and arranged to provide a removable flap which upon opening leaves a severed sharp edge on the chuckwall offset from the inner surface of said chuckwall toward the container sidewall subsequent to opening of the closure in a downwardly axial position.

* * * * *